US010231310B2

(12) United States Patent
Marent et al.

(10) Patent No.: US 10,231,310 B2
(45) Date of Patent: Mar. 12, 2019

(54) MODULE FOR LIGHTING MEANS WITH COMBINED SECONDARY-SIDE MEASUREMENT SIGNAL DETECTION

(71) Applicant: Tridonic GmbH & Co. KG, Dornbirn (AT)

(72) Inventors: Günter Marent, Barthlomäberg (AT); Christoph Vonach, Dornbirn (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 14/785,947

(22) PCT Filed: Apr. 25, 2014

(86) PCT No.: PCT/AT2014/000084
§ 371 (c)(1),
(2) Date: Oct. 21, 2015

(87) PCT Pub. No.: WO2014/172726
PCT Pub. Date: Oct. 30, 2014

(65) Prior Publication Data

US 2016/0073472 A1 Mar. 10, 2016

(30) Foreign Application Priority Data

Apr. 26, 2013 (DE) ..... 10 2013 207 710

(51) Int. Cl.
*H05B 33/08* (2006.01)

(52) U.S. Cl.
CPC ..... *H05B 33/0887* (2013.01); *H05B 33/089* (2013.01); *H05B 33/0815* (2013.01); *H05B 33/0848* (2013.01)

(58) Field of Classification Search
CPC ..... H05B 33/083; H05B 33/0833; H05B 33/0887; H05B 33/0815; H05B 33/0848;
(Continued)

(56) References Cited

U.S. PATENT DOCUMENTS 5,339,009 A * 8/1994 Lai ..... G05F 1/00 307/10.8
8,957,604 B2 2/2015 Harish Gopala Pillai et al.
(Continued)

FOREIGN PATENT DOCUMENTS

DE 20 2004 006292 U1 7/2004
DE 102008039530 A1 2/2010

OTHER PUBLICATIONS

International Search Report issued in connection with International Application No. PCT/AT2014/000084 dated Sep. 9, 2014.
(Continued)

*Primary Examiner* — Seokjin Kim
(74) *Attorney, Agent, or Firm* — The H.T. Than Law Group

(57) ABSTRACT

In one aspect, the invention provides a module for operating at least one lighting means, preferably at least one LED, said module having at least one electrically insulating barrier that separates a primary side, which can be supplied from a mains voltage, from a secondary side of the module, from which secondary side preferably the at least one LED can be supplied. On the secondary side are arranged a control circuit and a passive circuit which is connected to a single input of the control circuit and has at least two resistors, at least one of which is connected in series to a capacitor, the input being selectively connectable via a switch of the control circuit, and the control circuit being designed to detect at least two measurement signals at the input after switching of the switch depending on the degree of loading of the capacitor.

19 Claims, 3 Drawing Sheets

(58) Field of Classification Search
CPC ..... H05B 33/089; G05F 1/44; Y02B 20/346; H02M 3/33507; H02M 3/33523; H02M 2001/0025
See application file for complete search history.

(56) References Cited

U.S. PATENT DOCUMENTS

| | | | | |
|---|---|---|---|---|
| 2002/0150140 | A1 | 10/2002 | Julicher et al. | |
| 2007/0057902 | A1* | 3/2007 | Joung, II | G09G 3/3406 345/102 |
| 2008/0018261 | A1* | 1/2008 | Kastner | F21V 23/00 315/192 |
| 2010/0026208 | A1* | 2/2010 | Shteynberg | H05B 33/0815 315/297 |
| 2012/0119763 | A1 | 5/2012 | Adkins | |
| 2013/0193849 | A1 | 8/2013 | Zimmermann et al. | |
| 2014/0077724 | A1* | 3/2014 | Sawada | H02M 3/157 315/307 |

OTHER PUBLICATIONS

Machine translation of DE 20 2004 006292 U1 to Lichttech.
Machine translation of DE102008039530 to HELLA KGAA HUECK & CO.
Search Report of Austrian utility model application AT GM9015/2014 dated Oct. 23, 2017.

* cited by examiner

MODULE FOR LIGHTING MEANS WITH COMBINED SECONDARY-SIDE MEASUREMENT SIGNAL DETECTION

FIELD OF THE INVENTION

The present invention relates to a module for operating at least one lighting means/lighting means system, preferably at least one LED.

SUMMARY OF THE INVENTION

In particular, the invention relates to an LED module or an LED converter, which comprises an electrically insulating barrier, for example, a so-called SELV barrier (safety extra-low voltage barrier), that is, a safety extra-low-voltage barrier, which galvanically isolates, for example, circuit regions with safety extra-low voltage, from other circuit parts.

In this context, the invention relates more particularly to a module of which the output-power/output-current/output-voltage (in the following, only the term output-voltage is used) can be adjusted by selecting the output-voltage via a selection input of the module. For example, at least one selection resistor can be connected to the selection input, and the output-voltage can then be adjusted dependent upon a resistance value of the connected selection resistor.

A control circuit of the module accordingly detects a measurement signal which reproduces the resistance value of the connected resistor. In the following, this concept is designated as "Iselect". More particularly, a voltage signal or current signal can be picked up in the selection resistor with regard to the voltage/current through the lighting means (Iselect).

Furthermore, the invention relates to lighting-means modules which comprise a temperature measurement unit (for example, NTC, negative temperature coefficient resistor, PTC, positive temperature coefficient resistor, or thermistor).

Accordingly, the control circuit detects, alternatively or additionally, at least one further measurement signal which reproduces a temperature investigated by a temperature measurement unit. This can be, for example, a temperature coefficient, which is investigated, more particularly, by means of a variable electrical resistor, of which the value is varied in a reproducible manner through a temperature change. In this case, the measurement signal then indicates in turn a resistance value. In general, the measurement signals are voltages/currents which either reproduce resistance values or on the basis of which the resistance values can be determined.

The temperature is investigated in order to vary the output-voltage of the module dependent upon the investigated temperature, for example, in order to deactivate the module in the case of excessively high/excessively low temperatures. In the following, this concept is referred to as "ITM" (intelligent temperature management).

The electrically insulating barrier named above divides the module with reference to the barrier into a primary side and a secondary side. In this context, the primary side can often be supplied directly or indirectly originating from a mains power supply (AC/DC voltage/current), while the connectable lighting means can be supplied, directly or indirectly, originating from the secondary side.

Document DE 20 2004 006292 U1, which describes in general a feedback channel for the transmission of a value from a secondary side to a primary side, is known as the prior art. WO 2011/113 951 A2, which describes an LED module with a temperature sensor which is designed for a digital communication, is also known.

The object of the invention is to detect required measurement signals with a secondary-side control circuit, which requires the fewest possible inputs (input pins/measurement-signal access points), more particularly, only a single input. The invention accordingly discloses an arrangement and a method, as claimed in the independent claims. Further developments of the invention form the subject matter of the dependent claims.

In a first aspect, the invention discloses a module for operating at least one lighting means, preferably at least one LED, with at least one electrically insulating barrier, which isolates a primary side, which can be supplied originating from a mains power supply, from a secondary side of the module, from which the at least one lighting means can preferably be supplied, wherein a control circuit and a passive circuit are arranged on the secondary side, which is connected to a single input of the control circuit and which comprises at least two resistors, of which at least one is connected in series to a capacitor, wherein the input can be activated selectively via a switch of the control circuit, and wherein, after a after a switching of the switch, the control circuit is designed to detect at the input at least two measurement signals with a time interval, which are dependent upon the degree of charging of the capacitor. The passive circuit preferably is, or respectively comprises, a resistor circuit. The resistor circuit comprises, for example, measuring resistors or a measuring-resistor network and charge-storage devices/capacitors.

With charged capacitor, the control circuit can detect at least one first measurement signal and, with discharged capacitor, can detect at least one second measurement signal.

The capacitor can be charged or uncharged, when the switch switches. The switch can, of course, be embodied as a transistor (FET, MOS FET, . . . ).

At every detection time, at least one resistor of the passive circuit can be connected to a further resistor to form a voltage splitter.

The further resistor can be provided internally within the control circuit or externally to the latter.

The first and/or the second measurement signal can each reproduce a voltage/current value.

On the secondary side, a voltage supply can be provided, which is a part of the control circuit or connected to the control circuit.

The control circuit can comprise an A/D converter, which converts the detected measurement signals into measurement values.

The control circuit can communicate measurement values across the electrically insulating barrier to the primary side via a feedback element, more particularly an optocoupler.

The further resistor can connect the passive circuit to the voltage supply.

In the case of a switching, the switch can connect the passive circuit to the further resistor/voltage source.

At least one first resistor of the passive circuit can be connected detachably to the control circuit/can be manually replaceable. It can be replaced with a differently dimensioned resistor.

At least one second resistor of the passive circuit can be a variable electrical resistor, more particularly an NTC or a PTC, the value of which varies in a reproducible manner in the case of a temperature change.

After the switching of the switch, the first or the second measurement signal can reproduce a voltage value/resistance value, more particularly a combined voltage/resistance value.

The at least one resistor connected in series to the capacitor can make a contribution, for example, only to one of the detected measurement values when the capacitor is discharged.

After the switching of the switch, the capacitor can be charged or discharged. More particularly, the resistors are measuring resistors.

In a different aspect, the invention discloses a ballast for operating LED lighting means comprising a module as described above.

In a further aspect, the invention discloses a lamp comprising a ballast as described above.

In yet another aspect, the invention discloses a method for detecting several measurement values at a single input of a control circuit of a module for at least one LED, wherein, at the input of the control circuit, a passive circuit is connected, which comprises at least two resistors, of which at least one is connected in series to a capacitor, wherein the input can be selectively activated via a switch of the control circuit, and wherein, after a after a switching of the switch, the control circuit detects at the input at least two measurement signals with a time interval, which are dependent upon the degree of charging of the capacitor.

BRIEF DESCRIPTION OF THE DRAWINGS

The invention will now be described with regard to the Figs. The Figs. show.

DETAILED DESCRIPTION OF THE PREFERRED EMBODIMENTS

The invention therefore relates to modules in which secondary-side measurements are implemented by a control circuit (for example, IC, ASIC, microcontroller, . . . ), which are then communicated from the secondary side across the electrically insulating barrier to the primary side, for example, with the use of an optocoupler.

The detection or respectively the evaluation of the measurement signals on the secondary side is desirable in this case, because the temperature measuring unit (NTC, PTC) can thus be arranged close to the lighting means.

Furthermore, the selection resistor, which can be connected, for example, to a selection input of the module for the adjustment of the output-voltage, is a component which can be inserted and replaced by a human user, more particularly through differently dimensioned resistors. In this context, the human user can come into contact with conducting parts of the module, for which reason, the secondary side of the module can be operated with safety extra-low voltage (low-voltage power supply, SELV or LVPS, low-voltage power source). According to the invention, the module therefore comprises a voltage supply on the secondary side.

The invention accordingly relates to the purely secondary-side processing of different information. In this context, the invention is directed more particularly towards detecting the different information (measurement signals) in such a manner that the detection circuit used can be kept as simple as possible. For example, the object of the invention is to provide the fewest possible pins for the control circuit (integrated circuit).

Now, the general idea of the invention is that measurement signals, for example, different voltage values, which are read out at separate time intervals, are supplied to an A/D converter (analog-digital converter) of the control circuit, which, for example, on the one hand, reproduce a detected temperature and, on the other hand, reproduce a value which specifies the desired output-voltage or the output-voltage to be set. These measurement signals which are investigated in resistors, should therefore be detected with time separation so that this information can be communicated, for example, with a similar time separation across the electrically insulating barrier, to a primary-side control circuit.

Accordingly, what is involved is initially an analog coding of an information through the current value of the resistors (for example, measuring resistors, shunts). However, a more effort-intensive digital coding via a passive circuit (resistor circuit or measuring resistor network) would also be conceivable. In this manner, the control unit could also already detect at the input digital measurement values which directly reproduce a voltage/current/resistance value.

Figure 1:
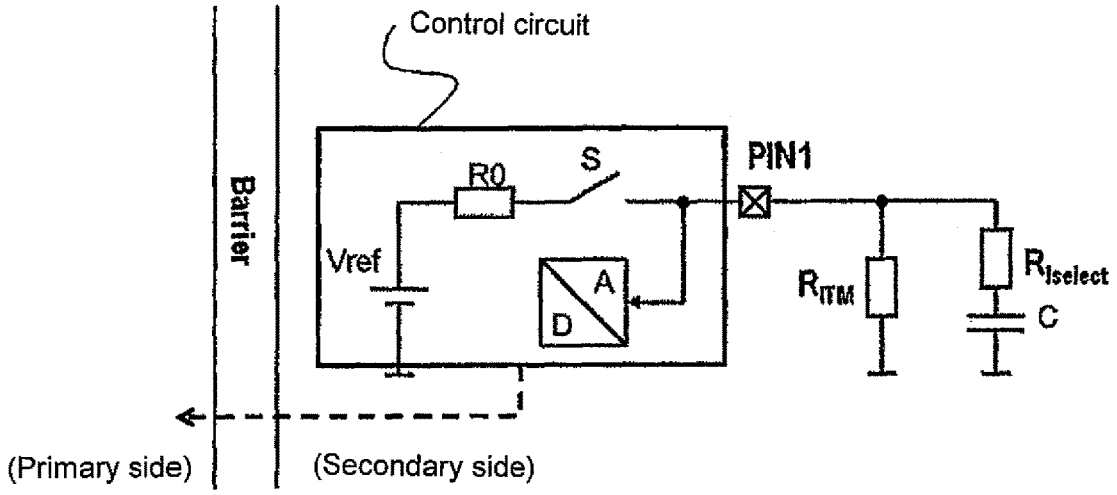
FIG. 1 an exemplary circuit arrangement according to the invention.
Figure 2:
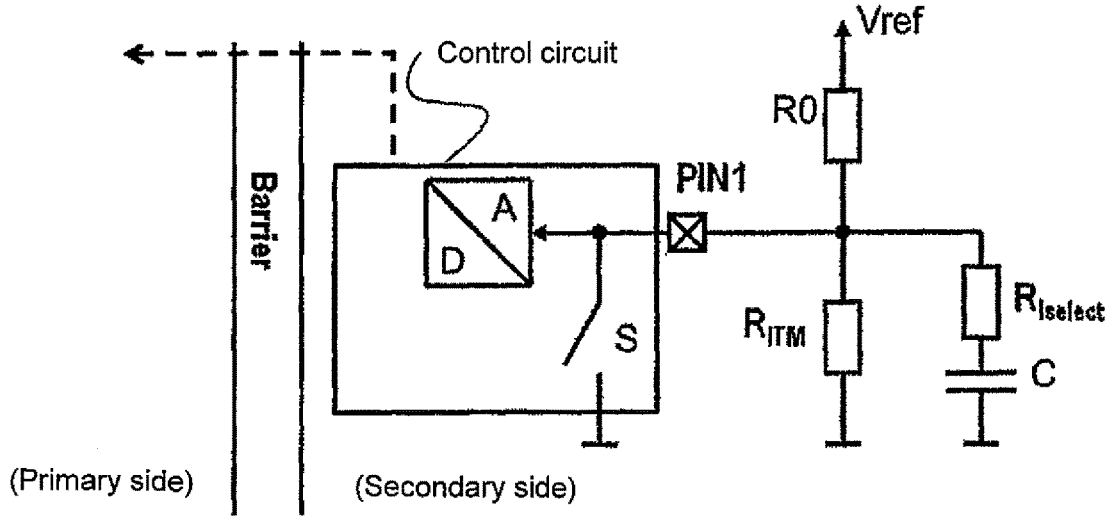
FIG. 2 an exemplary second circuit arrangement according to the invention.

As shown in FIGS. 1 and 2, the control circuit provided on the secondary side comprises at least one A/D converter, which converts analog measurement signals supplied to the control circuit into digital measurement values.

In FIG. 1, the detection of the measurement signals is implemented at the PIN 1. FIG. 1 shows a control circuit SE with an internal voltage supply which can supply a passive circuit external to the control circuit via a first internal resistor R0 and an internal switch S. The external passive circuit comprises at least two resistors, for example, a first measuring resistor designated in the following as a temperature measuring resistor $R_{ITM}$ and a second measuring resistor designated in the following as a selection resistor $R_{Iselect}$. A capacitor C is also connected in series to a resistor, here, the selection resistor $R_{Iselect}$.

A measurement signal delivered from the passive circuit is supplied to the A/D converter. After a conversion of the analog information by the analog-digital converter, the measured values can be further processed by the control circuit or, for example, communicated directly via an optocoupler on the primary side across the electrically insulating barrier.

Now, the detection of the measurement signals is implemented with time separation in that initially, the switch S is switched, and a measurement of the measurement signals delivered from the passive circuit is implemented immediately after this. In the present case, the delivered measurement signals are current and/or voltage signals.

When the switch S is closed, an abrupt current change/voltage change is applied to the passive circuit, so that, initially, a measurement signal is detected, which reproduces a voltage in the voltage splitter comprising the first resistor R0, the temperature measuring resistor $R_{ITM}$ and the selection resistor $R_{Iselect}$ connected in parallel to it. In this manner, a first measurement signal is detected when the capacitor C is discharged.

With a time interval from the detection of the first measurement signal, a second measurement signal is detected when the capacitor C is charged. The detected second measurement signal then outputs the voltage in the voltage splitter comprising the first resistor R0 and the temperature measuring resistor $R_{ITM}$.

Since a reference voltage $V_{ref}$ of the internal voltage supply and the internal first resistor R0 are known, only the two unknown parameters for the temperature measuring resistor $R_{ITM}$ and the selection resistor $R_{Iselect}$ therefore exist. Since the temperature measuring resistor $R_{ITM}$ can be determined separately through the second measurement signal as soon as the capacitor C is charged, the selection resistor $R_{Iselect}$ can also be determined by the control circuit SE making use of the first measurement signal.

In this context, it should be understood that the switch S is controlled either by the control circuit SE or integrated within the latter.

FIG. 2 shows an alternative to the circuit from FIG. 1 with voltage supply external to the control circuit SE.

In the case of the circuit arrangement from FIG. 2, with the switch S open, the capacitor C, which is charged via the voltage $V_{ref}$, is discharged as soon as the switch S is closed, that is, switched into the conducting state.

Now, if the switch S is closed, the capacitor C is discharged. Accordingly, in a first measurement, only a first measurement signal, which reproduces the voltage value in the voltage splitter formed by the first resistor R0 and the temperature measuring resistor $R_{ITM}$, is initially investigated by the control circuit SE. When the capacitor C is discharged, a measurement signal which reproduces the voltage of the voltage splitter formed by the first resistor R0, the temperature measuring resistor $R_{ITM}$ and the selection resistor $R_{Iselect}$ is investigated in a second measurement. In turn, the temperature measuring resistor $R_{ITM}$ and the selection resistor $R_{Iselect}$ are connected to one another in parallel, wherein the selection resistor $R_{Iselect}$ is connected in series to the capacitor C.

In total, therefore, so long as the capacitor C is charged, a measurement signal which depends only upon one resistor is investigated, while, otherwise, a measurement signal which depends upon several resistors is determined.

In this context, it must be understood that several resistors, which are connected, for example, to capacitors of different dimensions and which form a part of the observed voltage splitter dependent upon the charging condition of the corresponding capacitor, can also be provided. The control circuit is then embodied in such a manner that the time intervals of the measurements are designed corresponding to the capacitor dimensions.

Now, it can also be provided that the measurements are repeated at time intervals, or respectively periodically, in order to allow an averaging, or respectively a determination of the mean of the detected measurement values.

The optional feedback of detected measurement values is indicated in FIGS. 1 and 2 by a dashed-line arrow.

Figure 3:
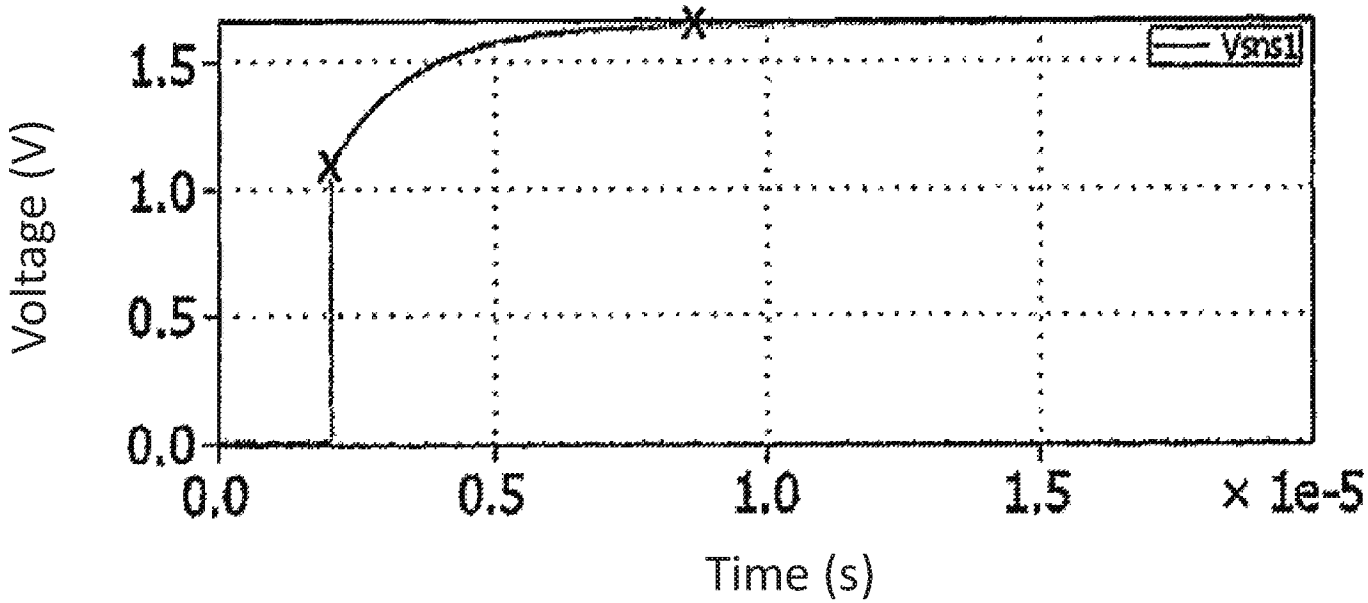
FIG. 3 an exemplary voltage characteristic detected by the control circuit.

FIG. 3 shows a characteristic curve of a simulation in which all resistors from FIG. 1 are selected with the value 1 kΩ, while the capacitor comprises the value 1 nF (Nano farad).

The first measurement must then be implemented directly after the abrupt voltage change shown in FIG. 3, while the second measurement can also be implemented later, for example, after approximately 10 microseconds.

By way of example, the value of the voltage splitter at the beginning is 1 kΩ to 500Ω, so that, for example, an applied voltage of 3.3 V must be divided by three. After the charging of the capacitor, the voltage splitter divides the voltage in the ratio 1 kΩ to 1 kΩ, after which the applied voltage of, for example, 3.3 V must be multiplied by 0.5.

In this context, the voltage $V_{sns1}$ illustrated in FIG. 3 is the voltage determined by the control circuit SE, that is, for example, via the analog-digital converter, dependent upon the applied voltage $V_{ref}$. The "x" markings show the times for the first and the second measurement by way of example, wherein the horizontal axis indicates the time and the vertical axis indicates the voltage values.

Of course, it is also possible, in the circuit arrangements from FIGS. 1 and 2, to connect the capacitor in series with the temperature measuring resistor $R_{ITM}$, and not in series with the selection resistor $R_{Iselect}$.

Figure 4:
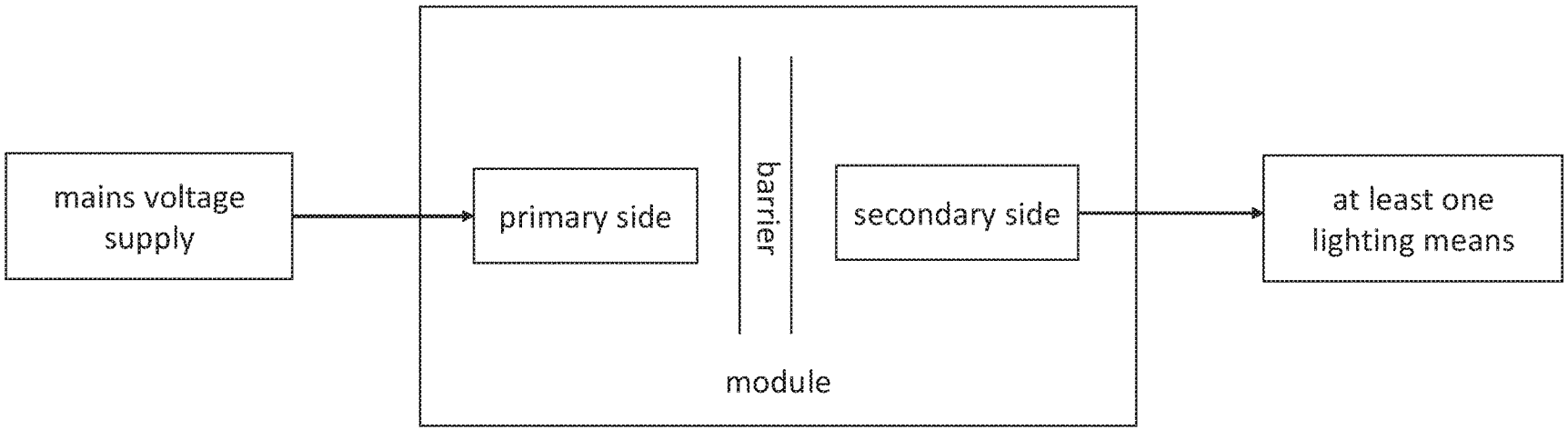
FIG. 4 a schematic drawing showing an example of the module for operating at least one lighting means according to the present invention.

As shown in FIG. 4, the module for operating at least one lighting means according to the present invention comprises at least one electrically insulating barrier which isolates a primary side from a secondary side of the module. The primary side of the module can be supplied originating from a mains voltage. From the secondary of the module at least one lighting means can be preferably supplied. Details of the module according to the present invention are described above with references to FIGS. 1 and 2.

The module can also comprise further barriers and can therefore be further subdivided as a whole.

The invention claimed is:

1. A module for operating at least one lighting means with at least one electrically insulating barrier which isolates a primary side, which can be supplied originating from a mains voltage supply, from a secondary side of the module, wherein a control circuit and a passive circuit are located on the secondary side, wherein the passive circuit is connected to a single input of the control circuit and comprises at least two measuring resistors, at least one of which is connected in series to a capacitor, wherein the input is selectively switchable via a switch of the control circuit, wherein, after a switching of the switch, the control circuit is designed to detect at the input at least two measurement signals with a time interval, which are dependent upon the degree of charging of the capacitor, wherein, at every time of detection, at least one measuring resistor of the passive circuit is connected to a further resistor to form a voltage splitter, and wherein the control circuit is designed to detect at least one first measurement signal when the capacitor is charged, and to detect at least one second measurement signal when the capacitor is discharged.

2. The module according to claim 1, wherein the capacitor is charged or uncharged when the switch switches.

3. The module according to claim 1, wherein the further resistor is provided internally within the control circuit or externally to the latter.

4. The module according to claim 1, wherein the first or the second measurement signal reproduces a voltage value or current value.

5. The module according to claim 1, wherein a voltage supply, which is a part of the control circuit or is connected to the control circuit, is provided on the secondary side.

6. The module according to claim 1, wherein the control circuit comprises an A/D (analog to digital) converter which converts the detected measurement signals into measurement values.

7. The module according to claim 1, wherein, via a feedback element, the control circuit communicates detected measured values across the electrically insulating barrier to the primary side.

8. The module according to claim 1, wherein the further resistor connects the passive circuit to a voltage source.

9. The module according to claim 1, wherein, in the case of a switching, the switch connects the passive circuit to the further resistor or to a voltage source.

10. The module according to claim 1, wherein at least one first measuring resistor of the passive circuit is connected detachably to the control circuit or is manually replaceable, and is replaceable with a differently dimensioned resistor.

11. The module according to claim 1, wherein at least one second measuring resistor of the passive circuit is a variable electrical resistor of which the value varies in a reproducible manner in the case of a temperature change.

12. The module according to claim 1, wherein, after the switching of the switch, the first or the second measurement signal reproduces a voltage value or resistance value.

13. The module according to claim 1, wherein the at least one measuring resistor connected in series to the capacitor makes a contribution to one of the detected measured values, when the capacitor is discharged.

14. The module for operating at least one lighting means according to claim 1 incorporated into a ballast.

15. The ballast for the operation of LED (light-emitting diode) lighting means according to claim 14 incorporated into a lamp.

16. A method for detecting several measured values at a single input of a control circuit of a module for at least one lighting means, wherein at least one electrically insulating barrier isolates a primary side from a secondary side of the module and the control circuit and a passive circuit are located on the secondary side, wherein the passive circuit, which comprises at least two measuring resistors, at least one of which is connected in series to a capacitor, is connected to the input of the control circuit, wherein the input is activated selectively via a switch of the control circuit, wherein, after a switching of the switch, the control circuit detects, at the input, with a time interval, at least two measurement signals which are dependent upon the degree of charging of the capacitor, wherein, at every time of detection, at least one measuring resistor of the passive circuit is connected to a further resistor to form a voltage splitter, and wherein the control circuit is designed to detect at least one first measurement signal when the capacitor is charged, and to detect at least one second measurement signal when the capacitor is discharged.

17. The module according to claim 1, wherein the at least one lighting means is a LED.

18. The module according to claim 1, wherein the at least one lighting means is supplied from the secondary side of the module.

19. The module according to claim 1, wherein, after the switching of the switch, the first or the second measurement signal reproduces a combined voltage and resistance value.

* * * * *